US005787544A

United States Patent [19]

Meade

[11] Patent Number: 5,787,544

[45] Date of Patent: Aug. 4, 1998

[54] COMBINED PAINT PACKAGE AND ROLLER TRAY

[75] Inventor: Jeffrey Meade, Natrona Heights, Pa.

[73] Assignee: PPG Industries, Inc., Pittsburgh, Pa.

[21] Appl. No.: 771,102

[22] Filed: Dec. 20, 1996

[51] Int. Cl.[6] ..... B44D 3/12

[52] U.S. Cl. ..... 15/257.06; 220/570

[58] Field of Search ..... 428/99, 34.1; 15/257.06; 220/570

[56] References Cited

U.S. PATENT DOCUMENTS

| | | | |
|---|---|---|---|
| D. 345,637 | 3/1994 | Chrisco et al. | D32/35 |
| 2,600,197 | 6/1952 | Braun | 15/121.2 |
| 2,905,371 | 9/1959 | Huff | 229/34 |
| 3,139,646 | 7/1964 | Vernon | 15/257.06 |
| 3,184,050 | 5/1965 | Dahlberg | 206/47 |
| 3,590,416 | 7/1971 | Henningsen | 15/257.06 |
| 4,199,836 | 4/1980 | Lovmark | 15/257.06 |
| 4,297,762 | 11/1981 | Crysdale | 15/257.06 |
| 4,651,379 | 3/1987 | Kern | 15/257.06 |
| 4,691,838 | 9/1987 | Graham et al. | 220/93 |

*Primary Examiner*—Alexander Thomas
*Attorney, Agent, or Firm*—Dennis G. Millman

[57] ABSTRACT

A paint roller tray is provided adapted for use with a flexible paint container. In one embodiment, the tray is provided with an orifice in a side wall portion that can be connected by way of a conduit to the paint container. By merely lifting the paint container above the level of the tray, paint flows into the tray in a completely enclosed path, whereby drips or spills are precluded. In another embodiment, a unitary package is provided that combines a roller tray with container means to hold a quantity of liquid paint, and conduit means to direct paint from the container into the tray portion of the apparatus. The apparatus is preferably disposable.

17 Claims, 4 Drawing Sheets

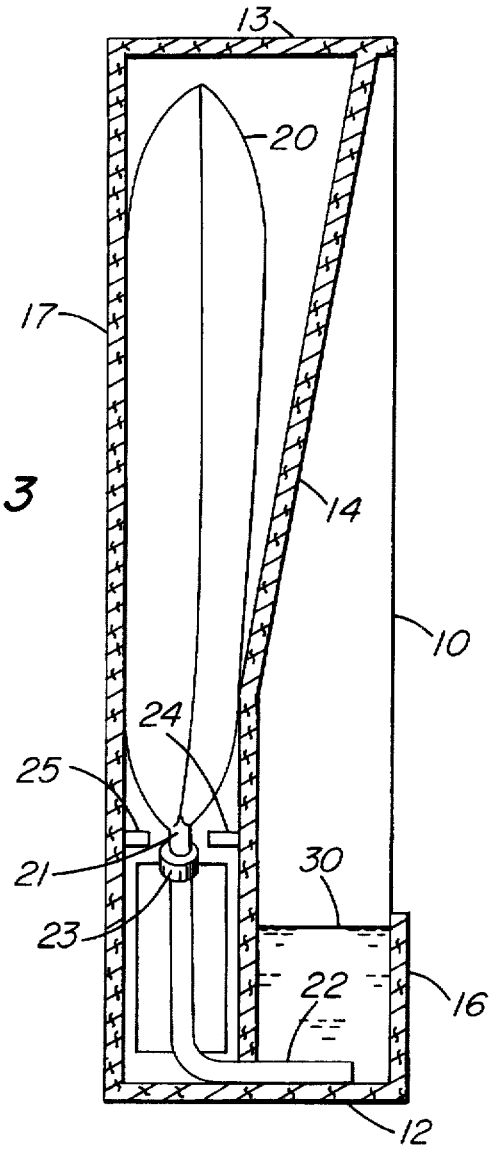
FIG. 3
FIG. 4
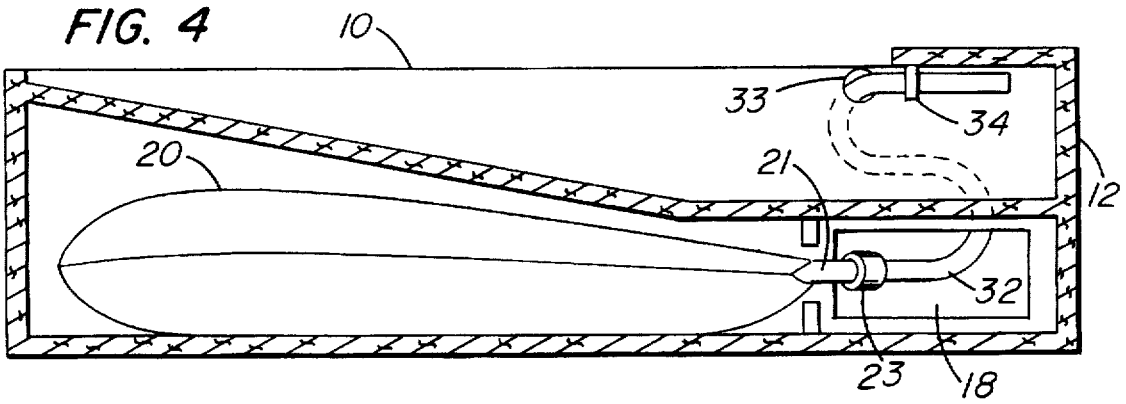

COMBINED PAINT PACKAGE AND ROLLER TRAY

BACKGROUND OF THE INVENTION

Because of their ease of use, paint rollers are frequently the preferred means for painting interior walls, particularly for do-it-yourself homeowners. Typically, painting with a roller requires the use of a paint tray, a shallow vessel usually having a relatively deep reservoir at one end for holding a quantity of paint and a sloped surface for distributing the paint evenly on the surface of the roller. Although the use of a paint roller substantially simplifies the job of painting, some consumers are discouraged from using paint rollers due to inconveniences associated with the paint tray. One objection is that the task of filling the tray by pouring paint from a conventional can of paint often leads to drips and spills of paint. The messiness of the filling step makes the job of painting unpleasant for some inexperienced users. Additionally, the job of cleaning the tray after painting is completed is perceived by many as a substantial nuisance that inhibits some from undertaking painting projects. Disposable paint trays have been developed in response to that complaint, such as can be seen in U.S. Pat. Nos. 2,905,371 and 3,184,050, but these do not address the messy pouring problem.

There have been attempts to redesign paint trays to eliminate or reduce the frequency of pouring paint into the tray by providing enlarged reservoirs from which paint can be metered into the roller contact area as shown in U.S. Pat. Nos. 2,600,197; 4,199,836; and 4,297,762. These still require paint to be poured from a can into the tray, at least initially. Furthermore, because of their complexity they do not lend themselves to being disposable, and cleaning would appear to be considerably more difficult than conventional paint trays. In U.S. Pat. No. 3,590,416 a paint tray is affixed to the top of an open can of paint, theoretically permitting direct flow of paint from the can into the tray through an orifice in the bottom of the tray. However, that approach has several drawbacks. First, the size of the tray appears to be somewhat limited in order for the tray to rest on top of a can in a reasonable manner. Secondly, providing a reliable seal between the tray and the can to prevent leaking of paint when pouring appears to be problematic. The preferred embodiment disclosed in the patent requires a specially constructed paint can having a threaded top, which undesirably entails additional cost in the manufacture of each can of paint or pouring the paint into a specialized can which must be cleaned after each use. Additionally, the complexity of the tray design in the patent may make disposability impractical.

It has been proposed to market paint packaged together with equipment for applying the paint, such as a paint tray and/or a roller. This not only provides convenience for the inexperienced painter who may not own the appropriate equipment, but also encourages the selling of paint at retail stores (e.g., grocery stores) that do not normally carry hardware such as painting equipment. The packaging of paint together with paint trays is disclosed in U.S. Pat. Nos. 2,905,371; 3,139,646; and 3,184,050. In U.S. Pat. No. 2,905,371 the container for several cans of paint doubles as a disposable paint tray. This is disadvantageously limited to the purchase of relatively large quantities of paint, and the combined package would be quite heavy. A drawback to the arrangement of U.S. Pat. No. 3,139,646 is that one is required to cut through the wall of a metal paint can to form the tray. The area of the resulting tray would also be rather restricted.

A desirable feature of the U.S. Pat. No. 3,184,050 is that paint is supplied together with a paint tray in light weight, flexible, plastic pouches. This has marketing advantages in that the reduced weight and packaging versatility could permit selling paint in stores other than the traditional paint and hardware stores. However, the concept of selling paint in plastic pouches has not gained widespread acceptance. A factor that may be discouraging its acceptance, is that, as embodied in the U.S. Pat. No. 3,184,050, opening the plastic pouches and pouring paint from them into the tray may be at least as messy as pouring from a can, thus discouraging use by non-professional painters. It would be desirable to improve the acceptance of paint sold in flexible, light weight containers.

Paste paints have been supplied in containers suitable for application by roller directly from the container. An example is disclosed in U.S. Pat. No. 4,691,838. Paste paints, however, have not gained significant acceptance. It would be desirable to use liquid paints without the drawbacks pointed out above.

SUMMARY OF THE INVENTION

In the present invention a paint roller tray is provided that avoids messy drips and spills associated with pouring paint into the tray. The tray is particularly adapted for use with a flexible paint container. In one embodiment, the tray is provided with an orifice in a side wall portion that can be connected by way of a conduit to the paint container. By merely lifting the paint container above the level of the tray, paint flows into the tray in a completely enclosed path, whereby drips or spills are precluded. The conduit is preferably in the form of a flexible tube which may form a fluid-tight connection with a bushing or nipple extending from the orifice in the tray. Resting the paint container on the floor next to the tray will stop the flow of paint into the tray, but if desired, a valve or tube clamp may be provided to positively shut off flow through the tube and to preserve the paint remaining in the container. The connecting means adds very little to the cost of the tray, so that it is practical for the tray to be disposable. The tray and a quantity of paint in a flexible paint container may be sold together as a kit in a conveniently merchandizable unitary package.

In another embodiment of the present invention, a unitary package is provided that combines a roller tray with container means to hold a quantity of liquid paint, further including conduit means to direct paint from the container into the tray portion of the apparatus. The apparatus is preferably disposable and serves as at least a portion of the packaging for retail merchandising of paint together with the roller tray. In this embodiment, an enclosed storage space in the package below the floor of the tray is adapted to hold a container of paint. The container may be a flexible container that can be removed from the storage space in the package and used as in the previous embodiment, or the storage space itself may be made fluid-tight so as to hold the paint. In those embodiments in which the paint container is held within the storage space, the container is connected to the tray by a conduit, and dispensing paint from the paint container into the tray area through the conduit is effected by tipping the package on end. In the up-ended position, paint flows by gravity into a reservoir portion of the tray defined by a lip extending from an end wall of the tray. A valve or tube clamp may optionally be provided in this embodiment in order to provide greater versatility.

THE DRAWINGS

FIG. 1 is a perspective view of a preferred embodiment of paint tray of the present invention FIG. 2 is a cross-sectional side view of a preferred embodiment of a paint tray of the present invention showing a flexible paint container within an internal storage area and one arrangement for directing paint from the container into the tray.

FIG. 2*a* is a fragmentary cross-sectional side view of an alternative end construction of the embodiment of FIG. 2.

FIG. 3 is a cross-section side view of the embodiment of FIG. 2 in the dispensing position.

FIG. 4 is a cross-sectional side view of an alternative embodiment showing a different arrangement for directing paint from the container into the tray.

DETAILED DESCRIPTION

This invention has particular utility in connection with flexible, polymeric, pouch-type containers for paint. The concept of packaging paint in such a container is not in itself novel, but the present invention provides a particularly useful implementation of that type of package. One reason that the flexible pouch package lends itself to the present invention is that such a package can be readily fitted with a tubular conduit type of opening, which, in turn, is readily adaptable to fluid-tight coupling with closed conduit means for conveying paint into the tray. This virtually eliminates the possibility of spilling or dripping paint while filling the tray. Another advantage of flexible packaging is that its contents can be emptied completely without the need for a vent opening, further precluding spillage. Yet another advantage is that the paint can be mixed within a flexible pouch without the need for opening the container. However, less than all of the advantages of the preferred embodiments can be obtained using paint containers other than a flexible pouch. Therefore, it should be understood that the more general aspects of the invention encompass the use of paint containers other than the flexible pouch type. For example, a substitute lid having an orifice adapted to be coupled to a conduit may be provided, whereby the lid from a conventional paint can is removed and the substitute lid installed in place thereof. In this embodiment, a vent opening would need to be provided in the substitute lid.

Figure 1:
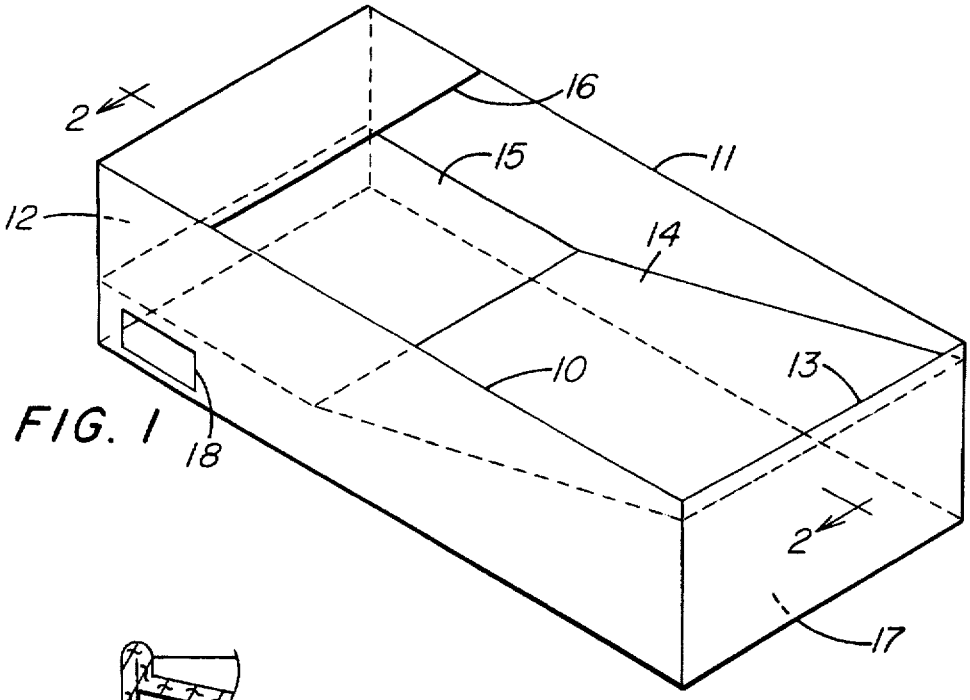

In FIG. 1, there is shown a paint roller tray of a particularly preferred embodiment of the present invention. In order to avoid the inconvenience of cleaning the tray after use, it is preferred that the tray be fabricated from a relatively inexpensive material that makes it economically feasible to dispose of the tray after use. Therefore, fiberboard or molded plastic is preferred. In the case of fiberboard, at least the areas that are to come into contact with paint may be provided with a polymeric coating as is known in the packaging materials industry to provide liquid barrier properties to the fiberboard if needed. Fiberboard is particularly preferred for those embodiments in which the paint is packaged together with the tray. However, if the advantage of disposability is foregone, other advantages of the invention may still be obtained with a permanent tray, e.g., a tray made of metal.

The tray depicted in FIG. 1 comprises a pair of opposite side walls 10 and 11, a pair of opposite end walls 12 and 13, and a floor which may be formed by a sloped section 14 and an adjoining horizontal section 15. Optionally the floor could consist of a single sloped section. The sloped floor provides the feature generally considered desirable for a paint tray of having a relatively deep section for holding a volume of paint and a drained section for removing excess paint from the paint applying tool. Thus, the wall 12 may be referred to as the deep end wall, and the wall 13 may be referred to as the shallow end wall. A novel feature of the embodiment of FIG. 1 is a generally horizontally extending flange 16 joined to the deep end wall 12 and the adjacent side wall portions, which assists charging paint into the tray as will be described in detail hereinbelow. The structural elements 10 through 16 are fabricated and joined together at their edges so as to form a liquid-tight, open-topped vessel adapted to hold a quantity of liquid paint and of sufficient size to receive a paint application tool such as a paint roller or pad. The details of fabricating such a structure from a single sheet of material or from separate pieces is well known in the packaging art, and a description of such details is not necessary for carrying out the present invention. The joints may be made liquid-tight by heat sealing, by use of adhesive sealants, or by coating the interior of the tray with a polymeric coating after fabrication. Alternatively, a molded, one-piece, polymeric liner could be inserted into a fiberboard frame.

Figure 2A:
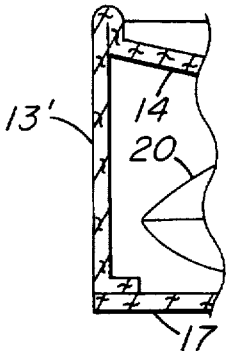

In the FIG. 1 embodiment, the floor sections 14 and 15 are spaced from a bottom panel 17, thereby forming an enclosed storage chamber on the underside of the tray. This storage space may hold a separate paint container such as a flexible plastic pouch which permits selling the paint and the tray as a single package. After purchase, the paint container may be removed from the storage space for use, in which case end wall 13 may conveniently be provided in the form of a hinged flap 13' (see FIG. 2*a*). Alternatively, the paint container may remain within the storage space during use, in which case means as will be described hereinafter may be provided for directing paint from the container into the tray. An access opening 18 into the storage space may be provided in the side wall 12 to facilitate placing the paint container into fluid communication with the tray. In another embodiment, the storage space may be made liquid-tight so that it may hold a volume of paint without the need for a separate container.

Figure 2:
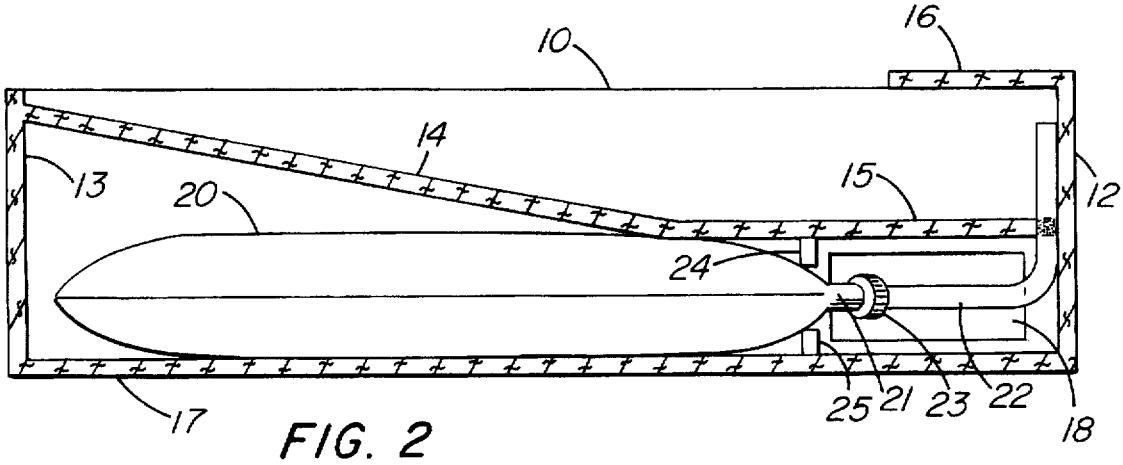
Figure 8:
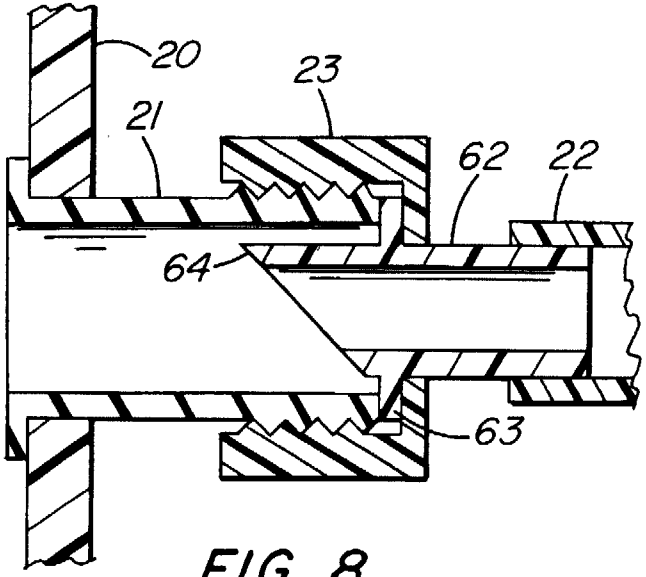
FIG. 8 is an enlarged cross-sectional view of a typical conduit connection arrangement which may be used with the present invention.

In FIG. 2, a flexible paint pouch 20 is shown within the storage space of a combination tray and package of the type shown in FIG. 1. The pouch 20 is provider with a tubular spout 21 sealed into the seam of the pouch and provided with closure means. Preferably, the closure means comprises threads at the end of the spout and a corresponding threaded storage cap (not shown). It is preferred that the spout additionally be sealed prior to use with a frangible, gas-tight material, such as metallic foil, adhered onto the end of the spout in a manner well known in the packaging art. This seal is adapted to be punctured upon connection with a paint conduit 22, which is advantageous because it virtually eliminates the possibility of paint being accidentally discharged from the open spout. An example of such a puncturing means is shown in FIG. 8, which is described hereinafter. Alternative closure and sealing arrangements as are known to those in the packaging art could be used in place of the particular arrangements described.

Conduit 22 may be connected at one end to spout 21, such as by a threaded cap 23. The connection may be made by the user through access opening 18. It may be advantageous to provide sufficient length and flexibility to the spout 21 and the conduit 22 to permit their ends to be withdrawn through the access opening 18 and manipulated outside the storage compartment so that making the connection therebetween is easier. The end of conduit 22 opposite from the connection to the paint pouch 20 terminates with an open end above horizontal floor section 15 of the paint tray, closely adjacent to end wall 12. Conduit 22 may follow any path from the storage compartment to the upper tray area. In the embodiment shown in FIG. 2, the conduit 22 passes through an orifice in the floor section 15, into which it may be sealed fluid-tight with sealant or adhesive. To prevent paint from flowing back into the pouch 20, the open end of conduit 22 preferably terminates at an elevation above the level to which paint would normally be contained in the reservoir portion of the tray. The orifice in the floor 15 through which the conduit 22 passes may be sealed by means of an adhesive or sealant compound so as to maintain the reservoir portion of the tray fluid-tight. Alternatively, if it is desired to avoid the need to seal an orifice, the conduit 22 may be routed around the outside and over an upper edge of the tray.

When the conduit 22 has been placed into fluid communication with the supply of paint in the pouch 20, the entire assembly may be lifted into a vertical orientation and rested on end 12 as shown in FIG. 3, whereupon paint flows by gravity from the pouch, through the conduit, into the reservoir portion of the tray as defined by the flange 16. In this embodiment, if the pouch 20 is not otherwise secured within the storage space, it may be desirable to provide retaining means such as tabs 24 and 25 to keep the pouch spaced from the end wall 12 when in the vertical position, thereby assuring the ability to completely empty the pouch by gravity. After a quantity of paint 30 accumulates in the reservoir, the tray may be returned to the horizontal position, ready for use with a painting tool. The size of the flange 16 is selected so as to define an appropriate maximum amount of paint in the reservoir while in the vertical position. When returned to the horizontal position, the volume of paint will preferably be such that its level will be below the upper end of the conduit 22, thereby preventing flow of paint from the tray back into the conduit. While painting progresses and the level of paint in the reservoir portion of the tray is depleted, the user need merely tip the tray into the vertical position for a few moments to replenish the quantity of paint in the tray. A handle (not shown) may optionally be provided on end wall 13 or side walls 10 or 11 for this purpose.

An alternative embodiment is shown in FIG. 4 wherein, instead of a fixed conduit 22, there is provided a conduit 32, which may initially be separate from the tray. After being coupled to paint pouch 20 as in the previous embodiment, conduit 32 may be directed out through the access opening 18 along the outside of the tray and inserted by the user into the interior portion of the tray such as through a hole 33 in the upper portion of side wall 10. Although not required, it is preferred that the conduit 32 be substantially flexible to facilitate these manipulations. The end of the flexible conduit 32 opposite from the connection to the paint vessel may be affixed within the reservoir portion of the tray by mean of a retainer 34 such as a hook or loop. Alternatively, the hole 33 may be omitted, and the conduit may be directed over the side edge of the tray into engagement with the hook 34. As in the embodiment of FIGS. 2 and 3, tipping the tray onto the end wall 12 causes paint to flow through conduit 32 into the reservoir of the tray by gravity.

Figures 5, 6:
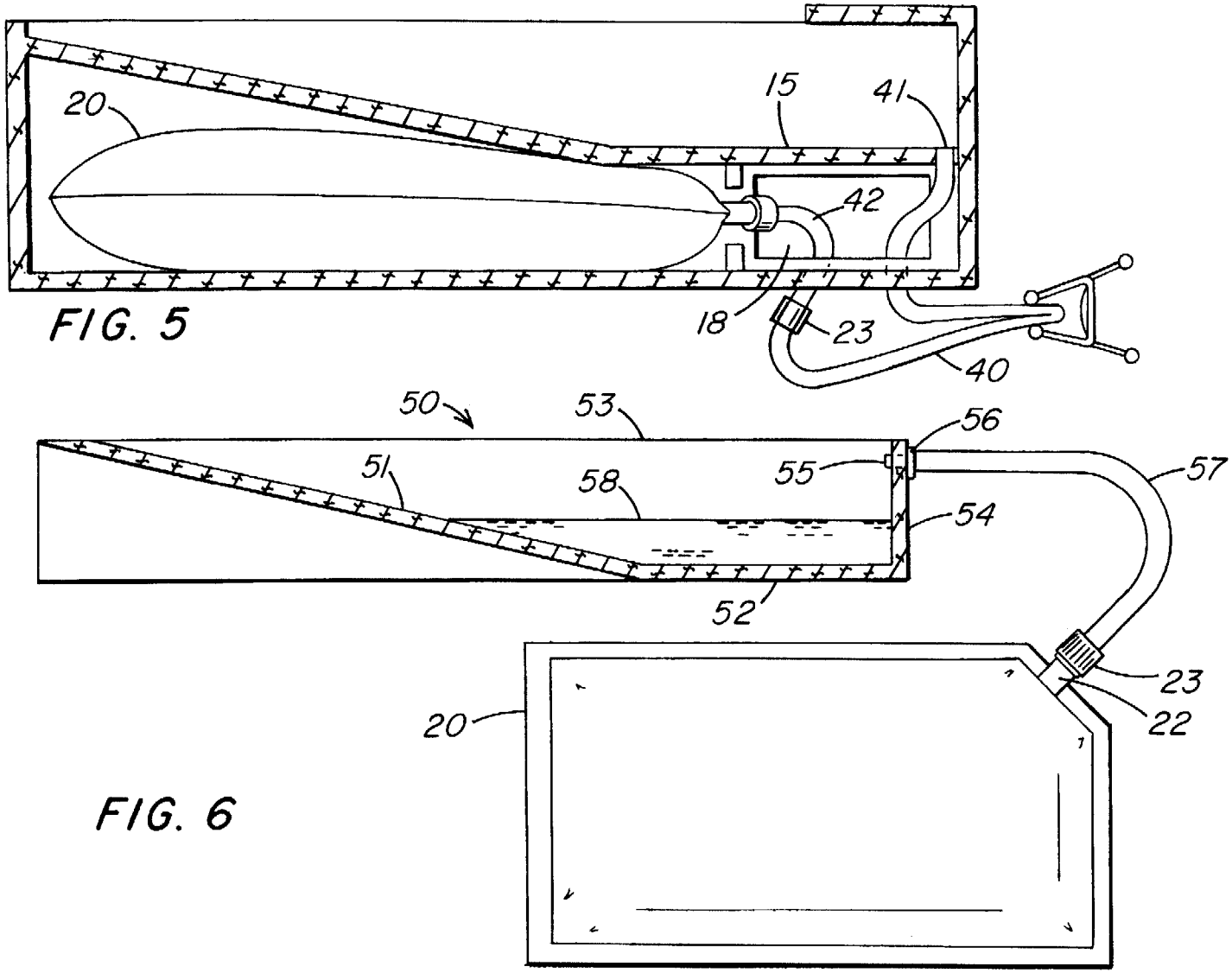
FIG. 5 is a cross-sectional side view of another alternative embodiment with another arrangement for directing paint from the container into the tray.
FIG. 6 is a cross-sectional side view of a tray without a paint storage area, with a connection to a free-standing flexible paint container.

Another alternative is depicted in FIG. 5, in which a flexible conduit 40 of extended length is provided. The conduit 40 in the embodiment depicted is in fluid communication with the reservoir portion of the tray by means of an orifice 41 in the floor 15. As shown in FIG. 5, the pouch may also be provided with a spout 42 which may preferably also be flexible and may be of sufficient length to be extendible outside the opening 18 in order to make it more convenient to attach the conduit 40 outside the confines of the storage space beneath the tray. The combined length of the conduit 40 and the spout 42 is sufficient so that a portion of the length outside the opening may be folded and pinched shut so as to shut off back-flow of paint from the tray into the pouch 20. The pinching may be carried out by various clamping means such as a spring type clamp 43 as shown, or any type of pinching device, such as a clothespin. It also may be possible to secure the folded tube with a rubber band. There are other tube clamp devices commercially available which may be used in this embodiment, such as Fisher polypropylene flow control clamp #05-8358 in the Fisher Scientific catalog, or Nalgene polypropylene pinch clamp #05-8358 in the Fisher Scientific catalog. These latter examples of tube clamps do not require the tube to be folded.

Figure 7:
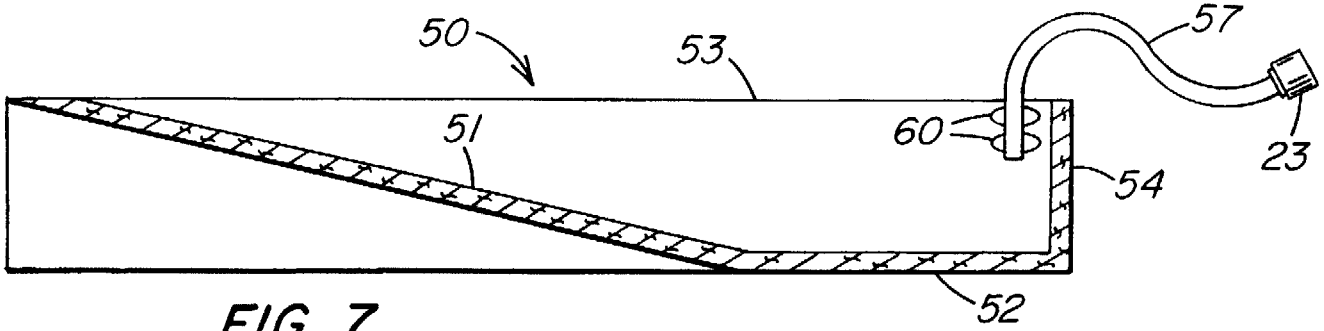
FIG. 7 is a cross-sectional side view of an alternative embodiment similar to FIG. 6 but with a different arrangement for affixing a paint conduit to the tray.

FIGS. 6 and 7 show simplified embodiments of the invention in which a supply of paint is not stored on-board the tray, but in which many of the advantages of the present invention are attained. In the FIG. 6 embodiment, a paint tray 50 is provided which may have a simplified construction that may differ from the embodiments previously described in that a lower storage space for holding a paint supply need not be provided. The tray 50 may be otherwise constructed in the same manner as described in connection with the previous embodiments, and is preferably made of inexpensive material that lends itself to being disposable. As in the other embodiments, the tray 50 may typically include a sloping floor portion 51 and a reservoir floor portion 52, enclosed by upstanding side walls 53 and end wall 54. An orifice 55, which may be provided with a fitting 56 such as a bushing or nipple, in the end wall 54 (or alternatively in a side wall). The fitting 56 enables a flexible conduit 57 leading from a paint pouch 20 to be connected to the interior of the tray in a fluidtight manner. The connection between the conduit and the nipple may be a simple friction fit or a threaded connection. Alternatively, the conduit 57 may be permanently sealed in engagement with the orifice 55. The orifice 55 is preferably located in the vicinity of the reservoir portion of the tray as defined by the reservoir floor portion 52, and also preferably in the upper portion of the wall so as to prevent flow-back of paint out of the tray through the conduit 57. Although dependent upon the particular geometry of a tray, the orifice 55 in a typical tray design is preferably located within the upper fifty percent of the height of the reservoir portion of the tray. By lifting the paint pouch 20 above the level of the orifice 55, paint flows into the tray through the conduit 57. When the level of paint 58 within the reservoir portion of the tray reaches the desired height, the pouch 20 is returned to rest on the floor or other surface alongside the tray, whereby flow of paint stops. In this manner, the reservoir can be periodically refilled with paint utilizing a completely enclosed path, whereby drips or spills are precluded. Although not necessary in this embodiment, a valve or tube clamp may be provided to positively shut off flow through the tube or for the sake of preserving a quantity of paint remaining in the pouch for later use. Although a specialized storage space for the paint container is not provided in the tray of this embodiment, the tray and a quantity of paint in a flexible paint container may be sold together as a unitary package by placing the pouch 20 or other paint vessel within the open space of the tray and wrapping both together for shipping, storing, and sales display.

A variation of the embodiment of FIG. 6 is shown in FIG. 7. In that variation, no orifice need be provided through a wall of the tray. Instead, the discharge end of the flexible conduit 57 is affixed to the inside of the tray 50 by means of adhesive 60. In place of adhesive, the means to affix the conduit 57 within the tray may be a clip or the like into which the discharge end of the conduit may be inserted by the user prior to use. In this embodiment, the conduit 57 is connected to a paint pouch or other paint containing vessel, which may be raised above the tray to introduce paint into the tray in the same manner as was described in connection with FIG. 6.

Figure 9:
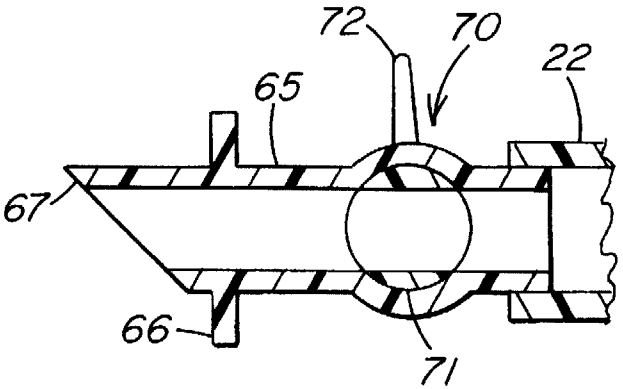
FIG. 9 is an enlarged cross-sectional view of a valved element that could be substituted in the FIG. 8 arrangement.

FIG. 8 is an enlarged view of an example of a connecting arrangement between a paint container such as a paint pouch 20 and a flexible conduit 22. The illustration makes reference to the elements of the embodiment of FIGS. 2 and 3, but it should be understood that the connecting arrangement could apply to any of the embodiments shown herein. The threaded cap 23 engages matching threads on the spout 21 extending from the paint pouch 20. A relatively rigid ferrule 62 is carried at an end of flexible conduit 22. A radial flange 63 is received inside cap 23 and is adapted to bear against the end of spout 23. The ferrule 62 may be provided with a sharpened tip for puncturing a seal across the end of the spout 23 in those embodiments in which such a seal is used. An alternative embodiment of a ferrule 65 is shown in FIG. 9, which includes a flange 66 and sharpened tip as in the FIG. 8. embodiment. The ferrule 65 additionally incorporates a valve 70 for shutting off the flow of paint in any of those embodiments where positive shut-off is desired. The valve includes a rotatable valve body 71 to which is connected a lever handle 72.

The conduits and spouts that constitute the fluid path for conveying paint from the storage container into the tray are sized so as to provide free flow of paint. With typical house paint viscosities, an inside diameter of at least about 0.25 inch (about 5 millimeters) is usually sufficient. An inside diameter of at least about 0.375 inch (about 9.5 millimeters) is preferred. The material from which the conduits are made may be any commonly available, polymeric tubing material, preferably one that is flexible for those embodiments that require flexibility. Examples are poly(vinyl chloride), polypropylene, and polyethylene. Low cost is usually the primary consideration.

Other embodiments can be envisioned that do not require elongated tubing between the paint container and the tray. Since a paint pouch has substantial flexibility itself, in an embodiment similar to that of FIGS. 2 and 3, the outlet of the pouch could be attached directly to a bushing (not shown) in an orifice in the reservoir floor 15. The attachment may be a snap fitting that may be effected by the user's finger inserted through the access opening 18. Such an arrangement may include a valve of the type shown in FIG. 9 to prevent flow of paint back into the pouch. Similarly, in an embodiment similar to that of FIGS. 6 and 7, a direct connection could be made between paint pouch and an orifice in a side wall portion of the tray.

Plastic pouches suitable for containing paint can be obtained from Kap-Pak Corporation, Minneapolis, Minn. The walls of preferred pouch embodiments from this supplier are believed to comprise laminations of various polymeric materials.

If it is desired to be able to custom tint the paint in the paint pouches, the pouches may be provided with an enlarged, capped opening to provide easier access for the tint dispensing equipment at the paint store. This enlarged opening could be in place of the single opening shown in the pouch 20 depicted in the drawings, or it could be an additional opening in the pouch.

Although this description has been set forth with reference to particular embodiments for the sake of providing the best mode of carrying out the invention, it should be understood that other variations and modifications as would be know to those of skill in the art can be resorted to without departing from the scope of the invention as defined by the claims.

I claim:

1. A paint tray comprising:

a paint dispending container having a substantially open top, formed by generally upright side walls and a floor, at least a portion of which is inclined so as to define a paint applicator receiving area within the container having one end more shallow than the opposite end;

an orifice through one of said side walls or floor; and means associated with said orifice adapted to provide fluid-tight connection to a flexible paint source.

2. The paint tray of claim 1 wherein the flexible paint source is an elongaged conduit.

3. The paint tray of claim 2 wherein the orifice extends through one of the side walls; and said means for proving fluid-tight connection comprises a fitting engaging said orifice and adapted to provide fluid-tight connection to said elongaged conduit.

4. The paint tray of claim 3 wherein the flexible paint source further includes a polymeric pouch container.

5. The paint tray of claim 2 wherein said conduit, at its opposite end from its connection to said fitting, is provided with a cap adapted to sealingly connect the conduit to a source of liquid paint.

6. The paint tray of claim 5 wherein said cap is internally threaded.

7. The paint tray of claim 1 wherein the flexible paint source is a polymeric pouch container.

8. The paint tray of claim 1 further including valve means in the paint flow path between the paint source and the paint dispensing container.

9. The paint tray of claim 8 wherein the orifice is in the floor of the paint dispensing container.

10. The paint tray of claim 1 further comprising:

a lower liquid paint storage chamber comprising an at least partially enclosed space below the paint dispensing container floor adapted to hold the source of liquid paint;

an enclosed, fluid-tight passage adapted to convey liquid paint, communicating at one end to said source of liquid paint and opening at its opposite end to said upper paint dispensing container.

11. The apparatus of claim 1 further including a lip above said paint dispensing container and joining said side walls, thereby defining a paint reservoir at one end of the paint dispensing container.

12. A paint tray comprising:

a container having a substantially open top, formed by generally upright side walls and a floor, at least a portion of which is inclined so as to define a paint applicator receiving area within the container having one end more shallow than the opposite end; and a conduit having an end affixed within and in fluid communication with said paint applicator receiving area above said floor, and having another end adapted to be connected to a source of liquid paint by means of a cap adapted to sealingly connect the conduit to the source of liquid paint, whereby the conduit is adapted to direct a flow of liquid paint into the applicator receiving area.

13. The paint tray of claim 12 wherein said cap in internally threaded.

14. The paint tray of claim 12 wherein said conduit is a flexible tube.

15. A paint tray comprising:

a container having a substantially open top, formed by generally upright side walls and a floor, at least a portion of which is inclined so as to define a paint applicator receiving area within the container having one end more shallow than the opposite end; and a conduit comprised of a flexible tube having an end affixed within and in fluid communication with said paint applicator receiving area above said floor, and having another end adapted to be connected to a source of liquid paint, whereby the conduit is adapted to direct a flow of liquid paint into the applicator receiving area.

16. The paint tray of claim 15 wherein said conduit is affixed within said paint applicator receiving area by adhesive.

17. The paint tray of claim 12 wherein said conduit is affixed within said paint applicator receiving area by a clip.

* * * * *

UNITED STATES PATENT AND TRADEMARK OFFICE

CERTIFICATE OF CORRECTION

PATENT NO. : 5,787,544

DATED : August 4, 1998

INVENTOR(S) : Jeffrey Meade

It is certified that error appears in the above-identified patent and that said Letters Patent is hereby corrected as shown below:

Claim 17, line 1: Delete [claim 12] and insert --claim 15--

Signed and Sealed this

Twenty-ninth Day of February, 2000

*Attest:*

Q. TODD DICKINSON

*Attesting Officer*

*Commissioner of Patents and Trademarks*